US009023250B2

(12) United States Patent
Li et al.

(10) Patent No.: US 9,023,250 B2
(45) Date of Patent: May 5, 2015

(54) METHOD FOR DECORATION OF SILVER ONTO CARBON MATERIALS

(71) Applicant: National Tsing Hua University, Hsinchu (TW)

(72) Inventors: Yu-An Li, Zhongli (TW); Nyan-Hwa Tai, HsinChu (TW)

(73) Assignee: National Tsing Hua University, Hsinchu (TW)

( * ) Notice: Subject to any disclaimer, the term of this patent is extended or adjusted under 35 U.S.C. 154(b) by 142 days.

(21) Appl. No.: 13/780,788

(22) Filed: Feb. 28, 2013

(65) Prior Publication Data

US 2014/0103267 A1 Apr. 17, 2014

(30) Foreign Application Priority Data

Oct. 17, 2012 (TW) ..... 101138167 A

(51) Int. Cl.
*H01B 1/04* (2006.01)
*H01B 1/02* (2006.01)
*H01B 1/24* (2006.01)

(52) U.S. Cl.
CPC ... *H01B 1/02* (2013.01); *H01B 1/24* (2013.01)

(58) Field of Classification Search
None
See application file for complete search history.

(56) References Cited

U.S. PATENT DOCUMENTS

2005/0244644 A1* 11/2005 Hampden-Smith et al. .. 428/408
2011/0186789 A1* 8/2011 Samulski et al. ..... 252/514
2011/0210282 A1* 9/2011 Foley ..... 252/62.51 R
2011/0223480 A1* 9/2011 Wee et al. ..... 429/218.1
2011/0247866 A1* 10/2011 Kim et al. ..... 174/257
2011/0284805 A1* 11/2011 Samulski et al. ..... 252/503
2012/0329640 A1* 12/2012 Bosnyak et al. ..... 502/100
2014/0054490 A1* 2/2014 Sundara et al. ..... 252/62.56

OTHER PUBLICATIONS

Suzuki et al., "Low-resistivity ITO films by dc arc discharge ion plating for high duty LCDs," J. of Non-Crystalline Solids, vol. 218, pp. 30-34 (1997).
Tak et al., "Criteria for ITO (indium—tin—oxide) thin film as the bottom electrode of an organic light emitting diode," Thin Solid Films, vol. 411, pp. 12-16 (2002).
Tseng et al., "Laser scribing of indium tin oxide (ITO) thin films deposited on various substrates for touch panels," App. Surf. Sci., vol. 257, pp. 1487-1494 (2010).
Shui-Yang Lien, "Characterization and optimization of ITO thin films for application in heterojunction silicon solar cells," Thin Solid Films, vol. 518, pp. S10-S13 (2010).
Tadatsugu Minami, "Present status of transparent conducting oxide thin-film development for Indium—Tin—Oxide (ITO) substitutes," Thin Solid Films, vol. 516, pp. 5822-5828 (2008).
Cairns et al., "Strain-dependent electrical resistance of tin-doped indium oxide on polymer substrates," Appl. Phys. Lett., vol. 76, No. 11, pp. 1425-1427 (2000).
(Continued)

*Primary Examiner* — Harold Pyon
*Assistant Examiner* — Jaison Thomas
(74) *Attorney, Agent, or Firm* — Muncy, Geissler, Olds & Lowe, P.C.

(57) ABSTRACT

The invention provides a method for decoration of silver onto carbon materials, comprising the following steps: functionalizing a first carbon material and a second material; mixing the functionalized first and second carbon materials into a first mixed solution through an alcohol solution; and mixing a silver solution and the first mixed solution into a second mixed solution.

9 Claims, 11 Drawing Sheets

(56) References Cited

OTHER PUBLICATIONS

Tsai et al., "Transfer of patterned vertically aligned carbon nanotubes onto plastic substrates for flexible electronics and field emission devices," Appl. Phys. Lett., vol. 95, pp. 013107-1-013107-3 (2009).
Chen et al., "Investigation of the electric conductivity and the electromagnetic interference shielding efficiency of SWCNTs/GNS/PAni nanocomposites," Diamond & Rel. Mat., vol. 20, pp. 1183-1187 (2011).
Nguyen et al., "Synthesis of ethanol-soluble few-layer graphene nanosheets for flexible and transparent conducting composite films," Nanotech., vol. 22, pp. 1-8 (2011).
Li et al., "Enhancing the Electrical Conductivity of Carbon-Nanotube-Based Transparent Conductive Films Using Functionalized Few-Walled Carbon Nanotubes Decorated with Palladium Nanoparticles as Fillers," ACS Nano, vol. 5, No. 8, pp. 6500-6506 (2011).
Oh et al., "Silver-plated carbon nanotubes for silver/conducting polymer composites," Nanotech., vol. 19, pp. 1-7 (2008).
Feng et al., "Electroless plating of carbon nanotubes with silver," J. of Mat. Sci., vol. 39, pp. 3241-3243 (2004).
Dai et al., "Synthesis of silver nanoparticles on functional multi-walled carbon nanotubes," Mat. Sci. & Eng. A, vol. 465, pp. 283-286 (2007).
Tseng et al., "Growth of Ag nanoparticles using plasma-modified multi-walled carbon nanotubes," Nanotech., vol. 19, pp. 1-8 (2008).
Wu et al., "One-step functionalization of multi-walled carbon nanotubes with Ag/polymer under γ-ray irradiation," Nanotech., vol. 19, pp. 1-7 (2008).
Oh et al., "Dispersing of Ag, Pd, and Pt—Ru alloy nanoparticles on single-walled carbon nanotubes by γ-irradiation," Mat. Lett., vol. 59, pp. 1121-1124 (2005).
Yang et al., "Controllable deposition of Ag nanoparticles on carbon nanotbues as a catalyst for hydrazine oxidation," Carbon, vol. 46, pp. 747-752 (2008).
Lee et al., "Highly transparent and conductive thin films fabricated with nano-silver/double-walled carbon nanotube composites," J. of Colloid & Interface Sci., vol. 364, pp. 1-9 (2011).
Kudelski et al., "Raman Study on the Structure of Cysteamine Monolayers on Silver," Langmuir, vol. 15, pp. 3162-3168 (1999).
Worley et al., "Removing sulfur from gold using ultraviolet/ozone cleaning," J. Vac. Sci. Technol. A, vol. 13, pp. 2281-2284 (1995).
Xu et al., "Solution-based synthesis and characterization of a silver nanoparticle-graphene hybrid film," Carbon, vol. 49, pp. 4731-4738 (2011).
Tien et al., "The production of graphene nanosheets decorated with silver nanoparticles for use in transparent, conductive films," Carbon, vol. 49, pp. 1550-1560 (2011).
Jiang et al., "Formation of silver nanoparticles in an acid-catalyzed silica colloidal solution," Appl. Surface Sci., vol. 233, pp. 135-140 (2004).
Qian et al., "Effect of Tungsten on the Purification of Few-Walled Carbon Nanotubes Synthesized by Thermal Chemical Vaport Deposition Methods," J. Phys. Chem. C, vol. 111, pp. 131-133 (2007).
Aviles et al., "Evaluation of mild acid oxidation treatments for MWCNT functionalization," Carbon, vol. 47, pp. 2970-2975 (2009).
Dan et al., "Continuous and Scalable Fabrication of Transparent Conducting Carbon Nanotube Films," ACS Nano, vol. 3, No. 4, pp. 835-843 (2009).
Baby et al., "Synthesis and nanofluid application of silver nanoparticles decorated graphene," J. of Mater. Chem., vol. 21, pp. 9702-9709 (2011).
Weaver et al., "Surface Characterization Stufy of the Thermal Decomposition of AgO," J. Phys. Chem., vol. 98, pp. 8519-8524 (1994).
Ortiz-Ibarra et al., "Surface characterization of electrodeposited silver on activated carbon for bactericidal purposes," J. of Colloid & Interface Sci., vol. 314, pp. 562-571 (2007).
Choi et al., "Spontaneous Reduction of Metal Ions on the Sidewalls of Carbon Nanotubes," J. Am. Chem. Soc., vol. 124, pp. 9058-9059 (2002).
Qu et al., "Substrate-Enhanced Electroless Deposition of Metal Nanoparticles on Carbon Nanotubes," J. Am. Chem. Soc., vol. 127, pp. 10806-10807 (2005).
Liu et al., "Graphene oxide sheet-prussian blue nanocomposites: Green synthesis and their extraordinary electrochemical properties," Colloids & Surfaces B: Biointerfaces, vol. 81, pp. 508-512 (2010).
Kong et al., "Single-Walled Carbon Nanotube Gold Nanohybrids: Application in Highly Effective Transparent and Conductive Films," J. Phys. Chem. C, vol. 111, pp. 8377-8382 (2007).
Shin et al., "Control of Electronic Structure of Graphene by Various Dopants and Their Effects on a Nanogenerator," J. Am. Chem. Soc., vol. 132, pp. 15803-15809 (2010).
Skakalova et al., "Effect of Chemical Treatment on Electrical Conductivity, Infrared Absorption, and Raman Spectra of Single-Walled Carbon Nanotubes," J. Phys. Chem. B, vol. 109, pp. 7174-7181 (2005).
Huang et al., "Spontaneous Formation of Silver Particles in Basic 2-Propanol," J. Phys. Chem., vol. 97, pp. 11542-11550 (1993).

* cited by examiner

METHOD FOR DECORATION OF SILVER ONTO CARBON MATERIALS

BACKGROUND OF THE INVENTION

1. Field of the Invention

This application claims priority of No. 101138167 filed in Taiwan R.O.C. on Oct. 17, 2012 under 35 USC 119, the entire content of which is hereby incorporated by reference.

The invention relates to a method for decoration of silver, particularly to a method for decoration of silver onto carbon materials.

2. Related Art

In the current field of the transparent conducting oxide, indium tin-doped oxide (ITO) is the most research and industrial application.

However, ITO is exposed to aerobic high-temperature (about 300° C.) environment, conductivity of ITO will significantly decrease because of oxygen vacancy. Moreover, the amount indium metal is continuing to decrease and difficult to obtain, price of indium metal will continue to rise, it will also cause the cost of transparent conductive film to increase year by year.

SUMMARY OF THE INVENTION

An objective of the present invention is to provide a method for decoration of silver onto carbon materials, which is applicable to all carbon materials.

An objective of the present invention is to provide a method for decoration of silver onto carbon materials, which is increasing conductivity of all carbon materials.

An objective of the present invention is to provide a method for decoration of silver onto carbon materials, which is forming a flexible transparent conductive composite.

The invention provides a method for decoration of silver onto carbon materials which comprising: functionalizing a first carbon material and a second carbon material; a mixing step, mixing the functionalized first carbon material and the functionalized second carbon material with an alcohol solution to form a first mixed solution; and mixing a silver ion with the first mixed solution to form a second mixed solution.

DETAILED DESCRIPTION OF THE INVENTION

Figure 1A:
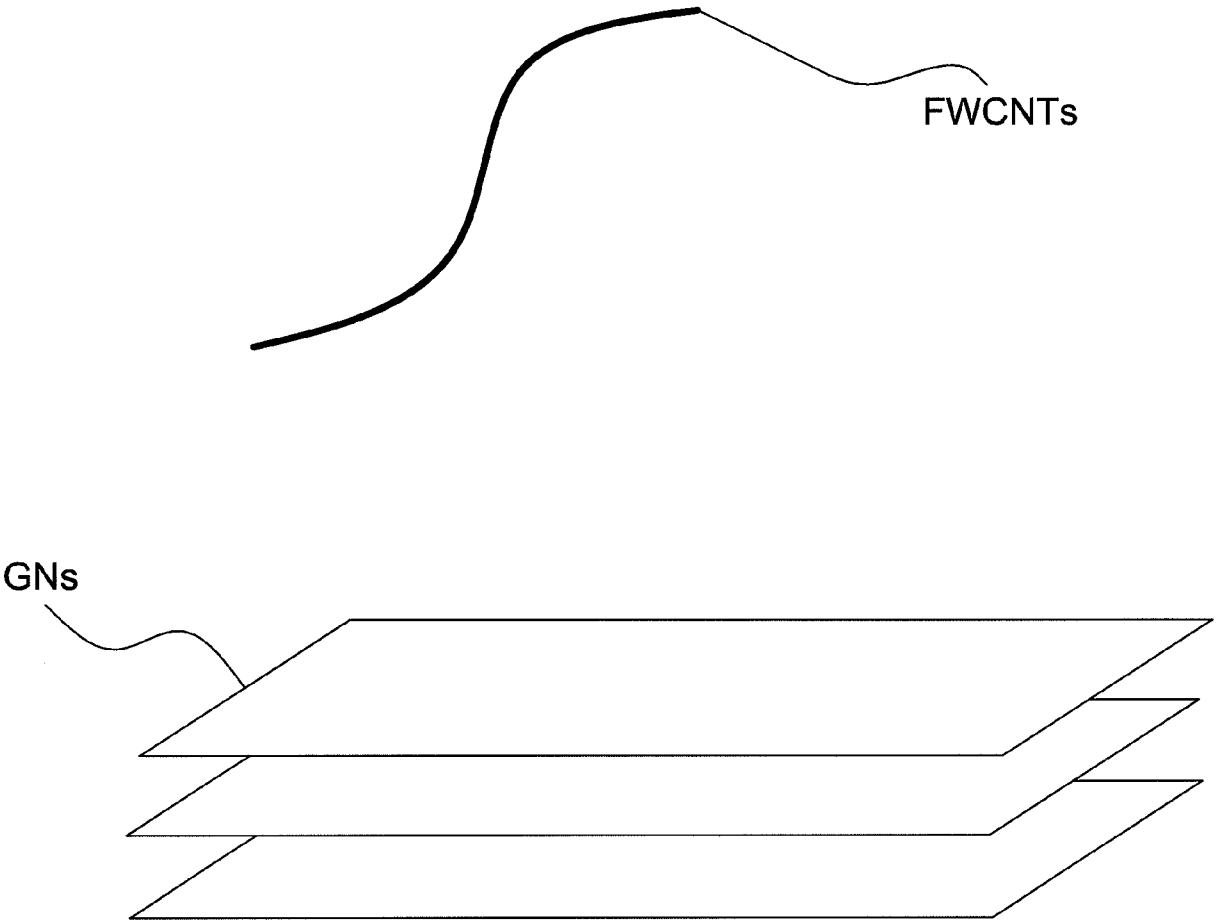
FIG. 1A shows a schematic diagram illustrating the selected carbon materials.

One embodiment of the present invention provides a method for decoration of silver onto carbon materials. Please refer to FIG. 1A, FIG. 1A shows a schematic diagram illustrating the selected carbon materials. In the present embodiment, carbon materials use few-walled carbon nanotubes (FWCNTs) and graphene nanosheets (GNs). It should not be limited in the present invention, carbon materials may use any current or future carbon materials. Wherein, few-walled carbon nanotubes have three to fifteen layers of carbon nanotubes; and GNs have three to fifteen layers of graphite flakes.

It should be noted that, single-walled carbon nanotubes (SWCNTs) contain more than two-thirds of CNTs with semiconductive property, it causes contact electrical resistance between SWCNTs to be too large to decrease conductivity. As the result, we use FWCNTs in present embodiment.

Figure 1B:
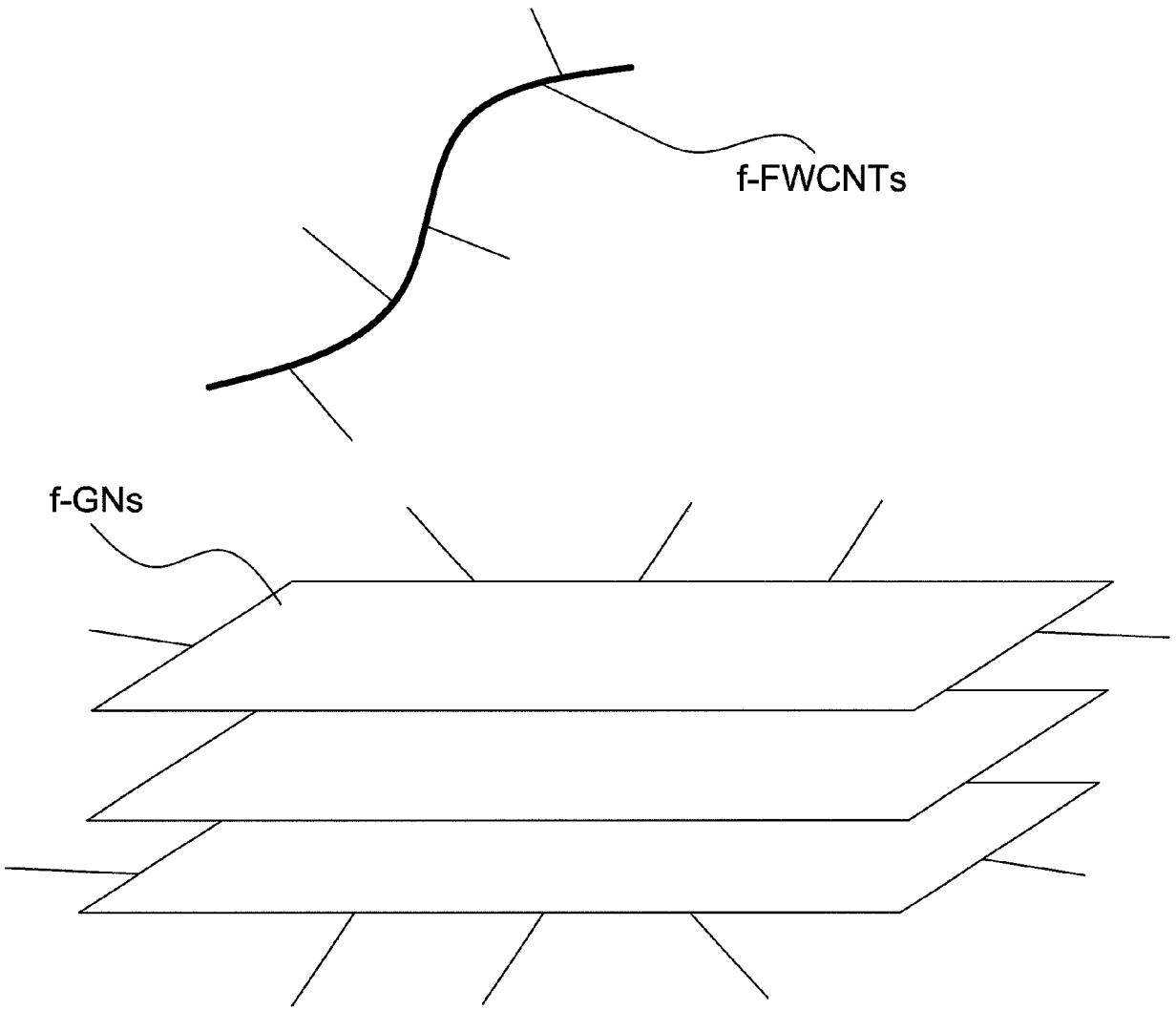
FIG. 1B shows a schematic diagram illustrating functionalization of the selected carbon materials.

Then, please refer to FIG. 1B, FIG. 1B shows a schematic diagram illustrating functionalization of the selected carbon materials. In the present invention, the carbon materials are in stable chemical properties, which is without having any functional group on the surface. Therefore, the selected carbon materials are not easily dispersed in an organic solvent or water. As the result, the selected carbon materials are functionalized through a strong acid. In the present embodiment, FWCNTs and GNs are individually immersed into a 3:1 v/v mixture of concentrated $H_2SO_4$ and $HNO_3$ and sonicated for one hour.

In the present embodiment, functionalized FWCNTs (abbreviation is f-FWCNTs) and functionalized GNs (abbreviation is f-GNs) mix with an alcohol solution to form a first mixed solution. The alcohol solution can be implemented by ethanol.

It should be noted that, the aforementioned mixing step can be implemented by another embodiment. f-FWCNTs and f-GNs are individually mixed with an alcohol solution to form a first solution and a second solution in first. Then, we mix the first solution with the second solution to form the first mixed solution.

Figure 1C:
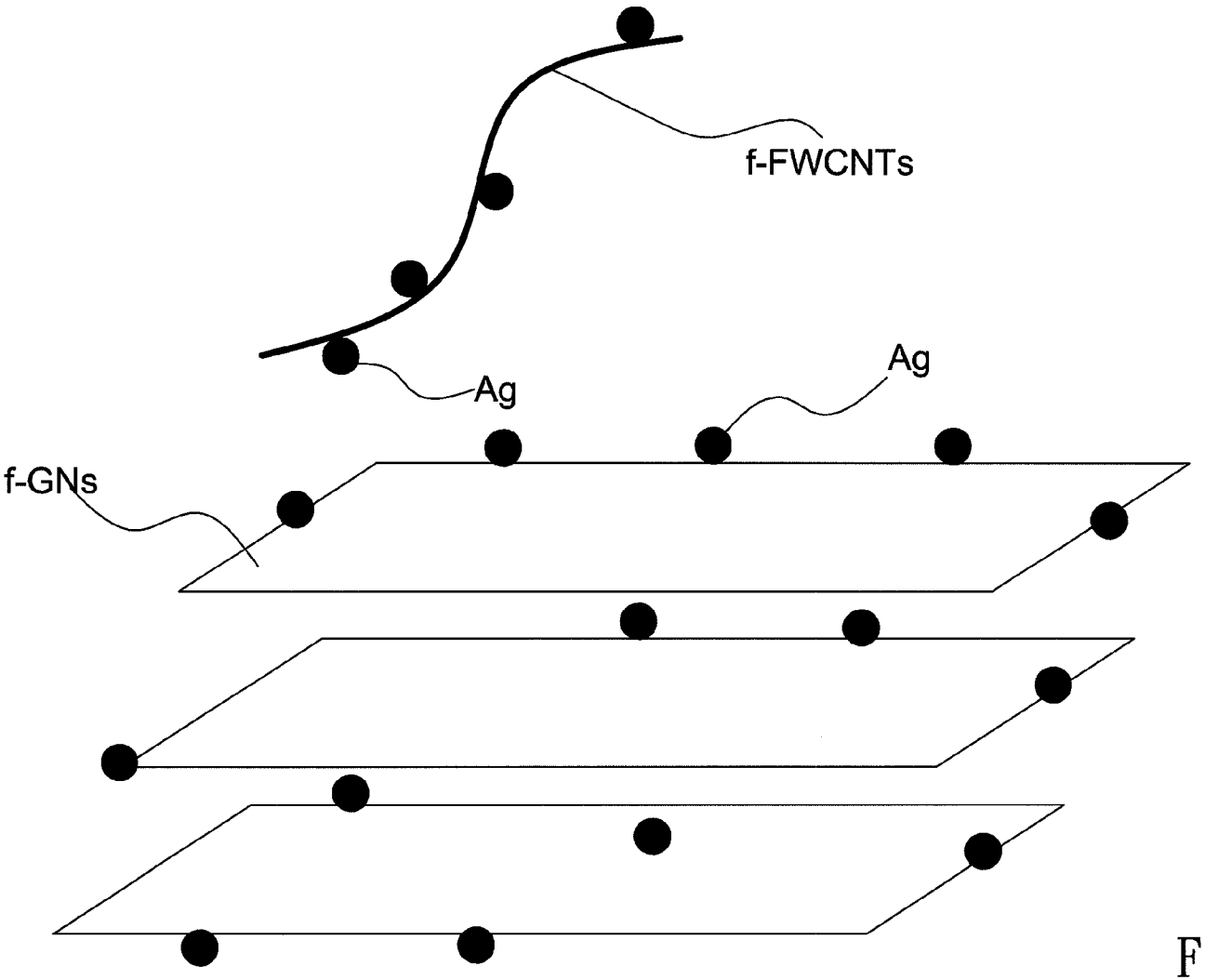
FIG. 1C shows a schematic diagram illustrating mixing of functionalized carbon materials and silver nanoparticles.

Finally, please refer to FIG. 1C, FIG. 1C shows a schematic diagram illustrating mixing of functionalized carbon materials and silver nanoparticles. In the present invention, silver ions mix with the first mixed solution to form a second mixed solution and complete the decoration of silver onto carbon materials. In the embodiment, silver ions are reduced from silver nitrate ($AgNO_3$).

The electrostatic attraction between the carboxyl groups on the f-FWCNTs and the f-GNs can cause the migration of Ag ions, which are reduced from $AgNO_3$, to the surfaces of the f-FWCNTs and the f-GNs. Then, Ag ions are reduced to silver nanoparticles by ethanol, silver nanoparticles are deposited on surface of the f-FWCNTs and the f-GNs to complete the decoration of silver.

Otherwise, ethanol plays dual roles as a solvent and as a weak reagent for reducing Ag ions to Ag nanoparticles. The Ag ions are supplied from $AgNO_3$ dissolved in the ethanol solution and diffused them onto the surfaces of f-FWCNTs and f-GNs, subsequently reacting with grafted $OH^-$ groups on those surfaces to form $Ag_2O$ nanoparticles. These $Ag_2O$ nanoparticles are then reduced by the ethanol in situ and deposited Ag nanoparticles on the surfaces of f-FWCNTs and f-GNs. The process can be expressed by the following equations (1)~(4):

$$2Ag^{+}+2OH^{-}_{ads}\rightarrow Ag_2O_{ads}+H_2O \quad (1)$$

$$Ag_2O_{ads}+CH_3CH_2OH\rightarrow CH_3CHO+2Ag_{ads}+H_2O \quad (2)$$

$$Ag_2O_{ads}+CH_3CHO\rightarrow CH_3COO^{-}+2Ag_{ads}+H^{+} \quad (3)$$

$$H^{+}+OH^{-}_{ads}\rightarrow H_2O \quad (4)$$

The overall reaction can be written as following equation (5):

$$4Ag^{+}+5OH^{-}_{ads}+CH_3CH_2OH\rightarrow CH_3COO^{-}+4Ag_{ads}+4H_2O \quad (5)$$

Wherein, $OH^{-}_{ads}$, $Ag_2O_{ads}$, and $Ag_{ads}$ refer to the $OH^{-}$ groups, the $Ag_2O$ intermediates, and the Ag nanoparticles that are ad-sorbed onto the surfaces of f-FWCNTs or f-GNs. $Ag_2O$ is reduced to Ag nanoparticles, The ethanol is oxidized to acetaldehyde and then to acetate as the final product while reducing the $Ag_2O$ nanoparticles to Ag nanoparticles. The process can be expressed by the following equations (6)~(8):

$$Ag_2O+2H^{+}+2e^{-}\rightarrow 2Ag+H_2O \quad (6)$$

$$CH_3CH_2OH\rightarrow CH_3CHO+2H^{+}+2e^{-} \quad (7)$$

$$CH_3COO^{-}+2H^{+}+2e^{-}\rightarrow CH_3CHO+H_2O \quad (8)$$

Figure 1D:
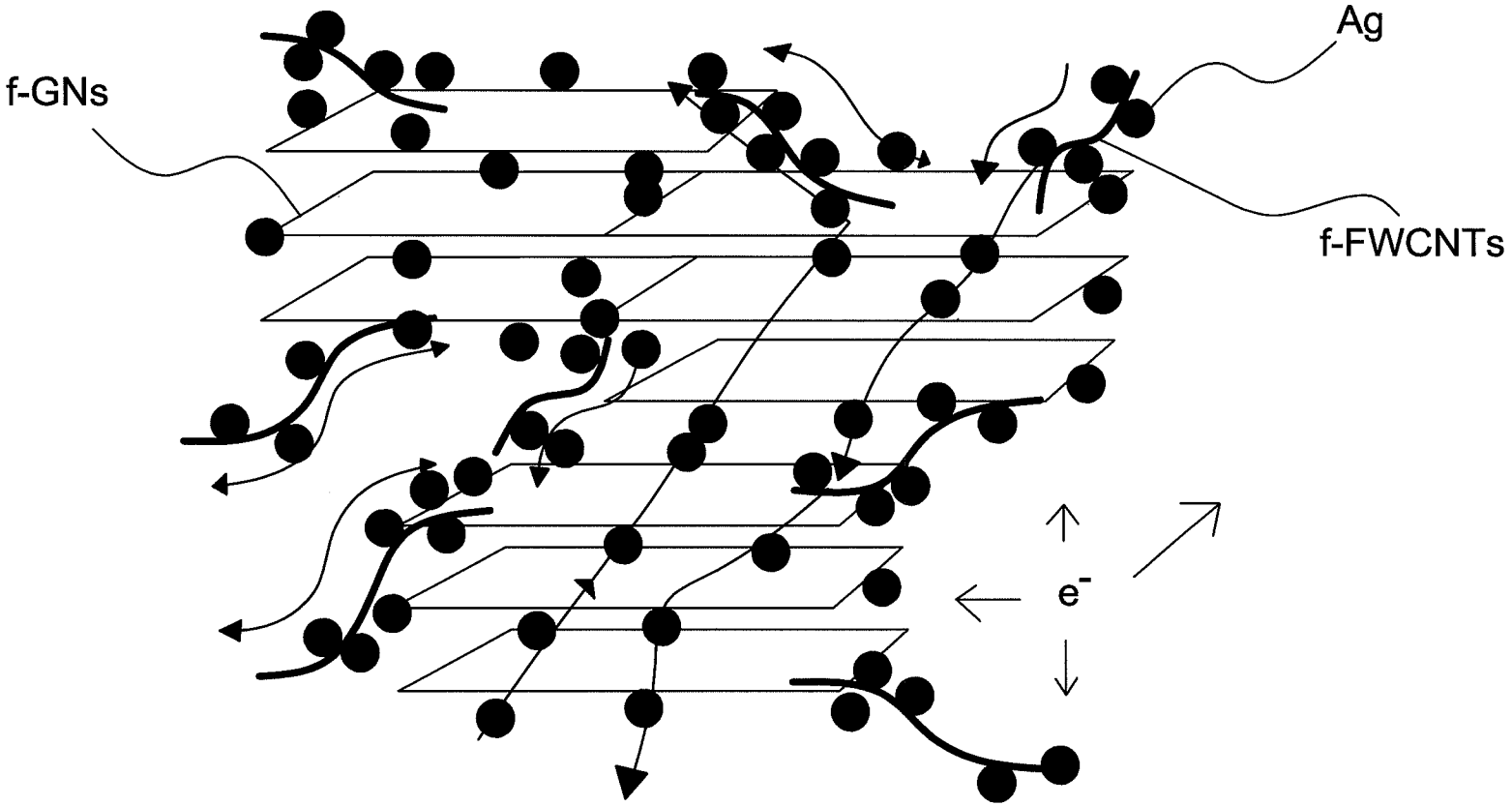
FIG. 1D shows a schematic diagram illustrating mixing of the second mixed solution and an organic conductive polymer.

Please refer to FIG. 1D, FIG. 1D shows a schematic diagram illustrating mixing of the second mixed solution and an organic conductive polymer. In the present invention, the second mixed solution mixes with an organic conductive polymer to form flexible transparent conductive film (TCFs). It should be noted that, organic conductive polymer can be implemented by poly(3,4-ethylenedioxythiophene)-poly(4-stryrenesulfonate) (PEDOT:PSS) in this embodiment.

Figure 2A:
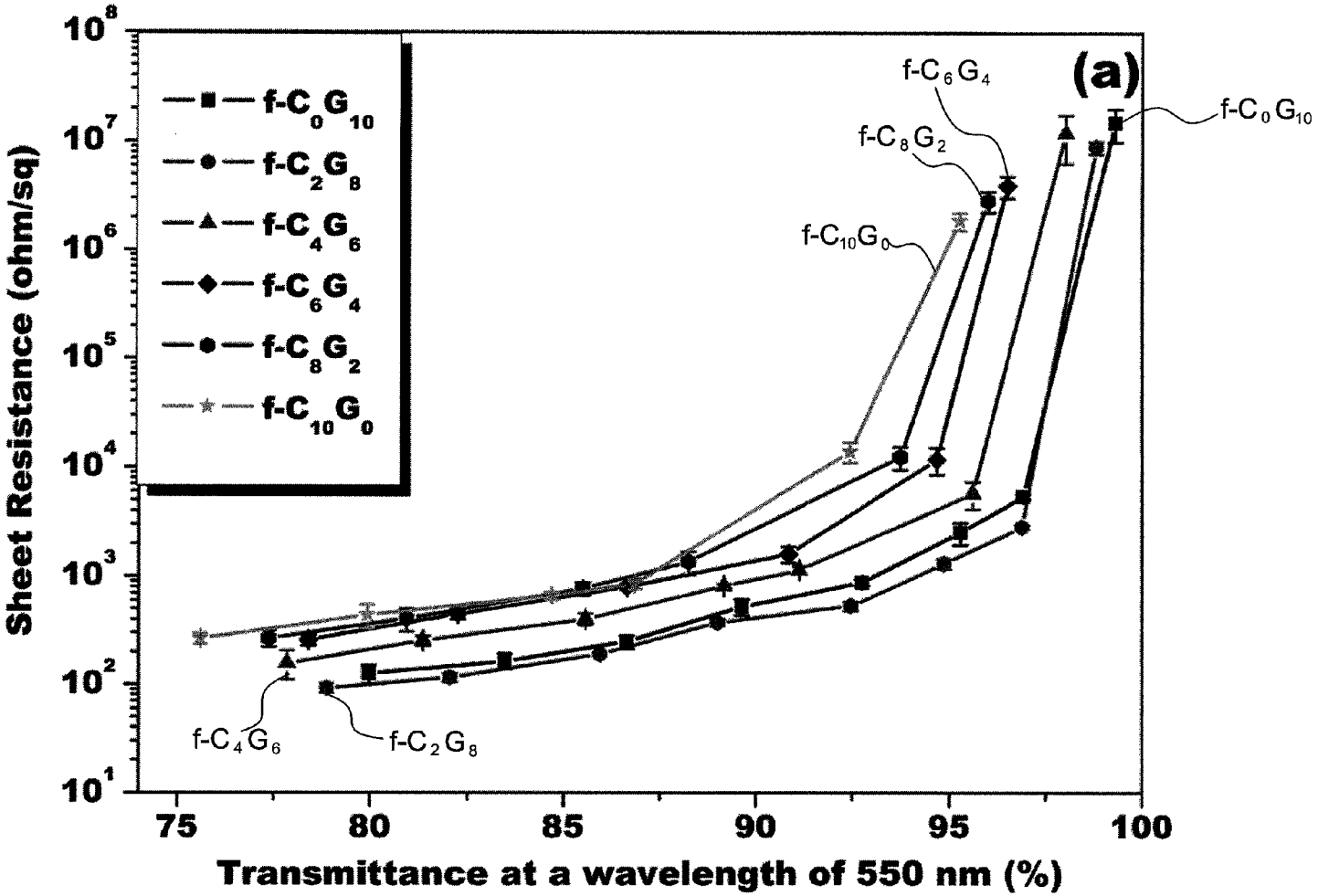
FIG. 2A shows a schematic diagram illustrating sheet resistance of f-$C_xG_{10-x}$.
Figure 2B:
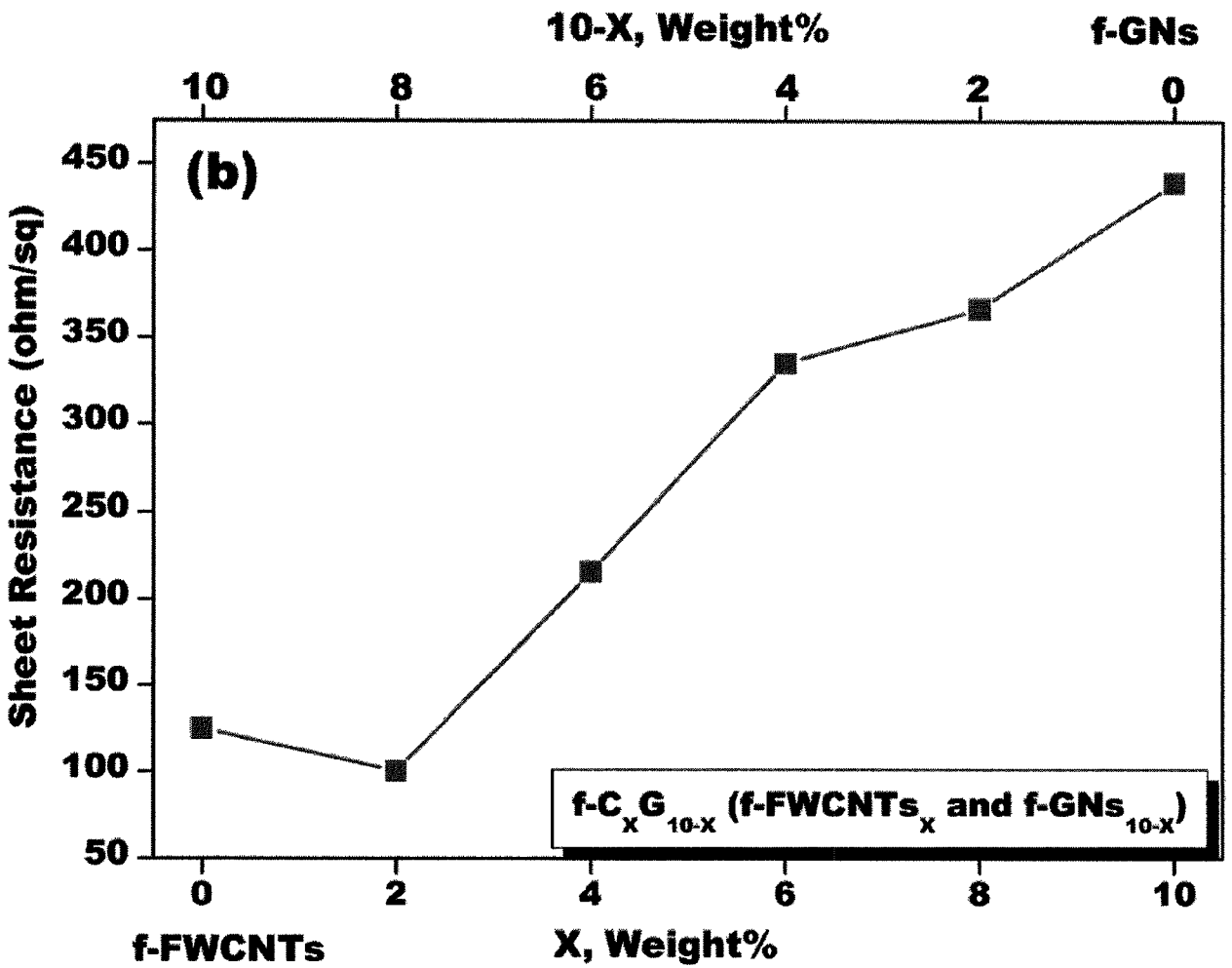
FIG. 2B shows a schematic diagram illustrating the corresponding sheet resistance of f-FWCNTs and f-GNs under different weight percent.

Moreover, the present invention utilizes TCFs, which are manufactured from f-FWCNTs and f-GNs, to make sheet resistance test. Please also refer to FIGS. 2A and 2B. FIG. 2A shows a schematic diagram illustrating sheet resistance of f-$C_xG_{10-x}$. FIG. 2B shows a schematic diagram illustrating the corresponding sheet resistance of f-WCNTs and f-GNs under different weight percent (wt %). When 2.0 wt % of f-FWCNTs and 8.0 wt % of f-GNs are used, the TCFs will have an extremely low sheet resistance.

The present invention utilizes Ag ions, which are supplied from $AgNO_3$, to increases the electron hole concentration in the PEDOT:PSS and carbon materials (the f-FWCNTs and the f-GNs), therefore enhancing the electrical conductivity of these materials. Wherein, we refer to Ag nanoparticles, distributed on the surfaces of the f-FWCNTs, as Ag@f-FWCNTs; and we refer to Ag nanoparticles, distributed on the surfaces of the f-GNs, as Ag@f-GNs.

In one embodiment, When a PEDOT:PSS matrix containing 2.0 wt % of Ag@f-FWCNTs and 8.0 wt % of Ag@f-GNs are coated onto a poly(ethylene terephthalate) film, outstanding optoelectronic properties of the film with a sheet resistance of 50.3 ohm/sq and a transmittance of 79.73% at a wavelength of 550 nm are achieved.

Figure 3:
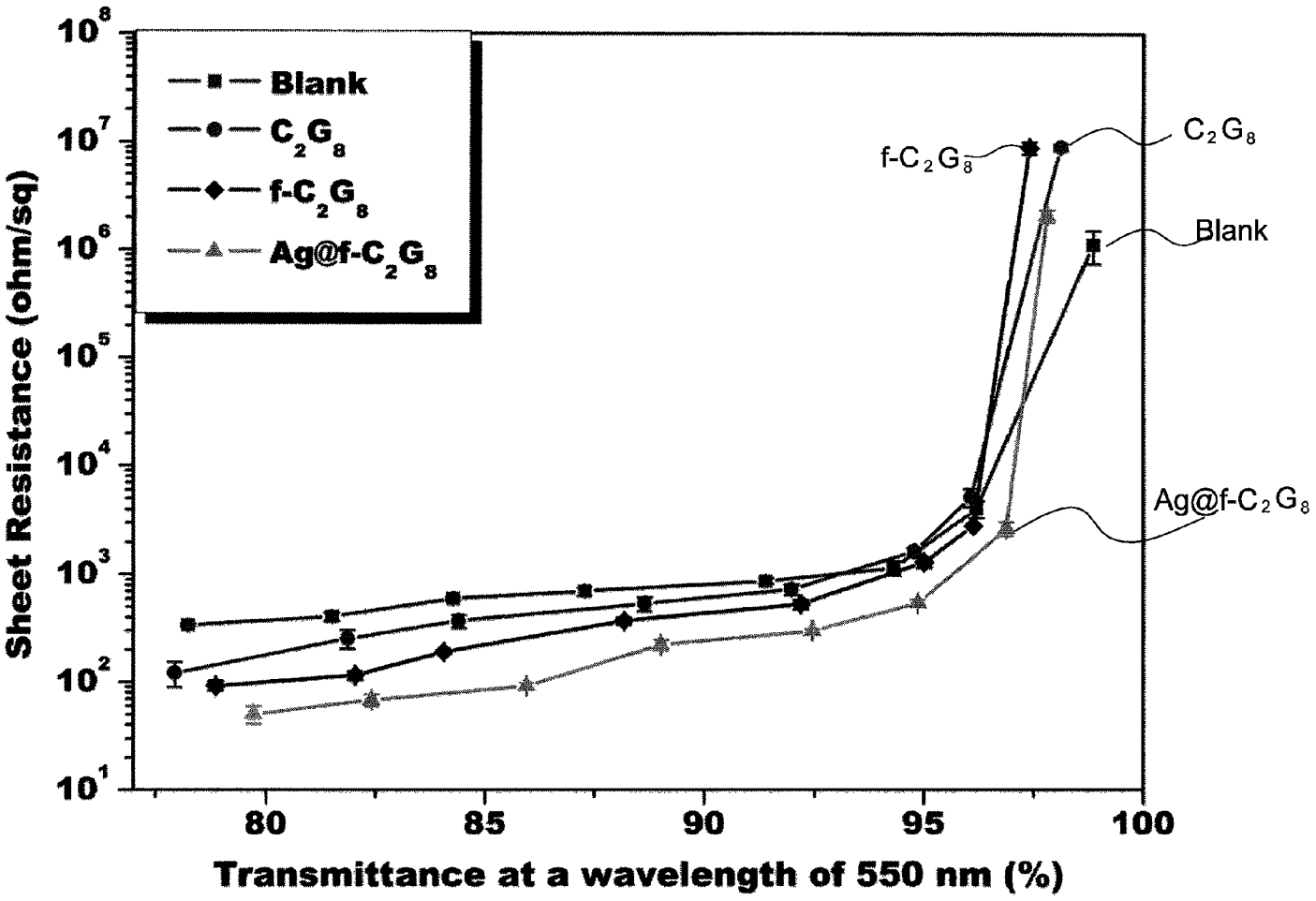
FIG. 3 shows a diagram illustrating relationship between the sheet resistances and the optical transmittances of the flexible transparent conductive films.

Then, please refer to FIG. 3, FIG. 3 shows a diagram illustrating relationship between the sheet resistances and the optical transmittances of the flexible transparent conductive films. The Blank film refers to the PEDOT:PSS-based TCFs that do not contain any fillers; the $C_2G_8$ film refers to the PEDOT:PSS-based TCFs that contain 2.0 wt % of FWCNTs and 8.0 wt % of GNs; the f-$C_2G_8$ film refers to the PEDOT:PSS-based TCFs that contain 2.0 wt % of f-FWCNTs and 8.0 wt % of f-GNs; and the Ag@f-$C_2G_8$ film refers to the PEDOT:PSS-based TCFs that contain 2.0 wt % of Ag@f-FWCNTs and 8.0 wt % of Ag@f-GNs.

However, for a transmittance that is lower than 95%, the sheet resistance of the Blank sample is kept within the range of 102 to 103 ohm/sq. The use of FWCNTs and GNs as hybrid fillers reduced the electrical sheet resistance of the TCFs significantly. The f-$C_2G_8$ film exhibits a better performance in terms of electrical sheet resistance than the $C_2G_8$ film because the functionalization process generates a p-dopant effect on the functionalized fillers, which decreases the overall electrical resistivity of the film. The film incorporated with Ag@f-$C_2G_8$ possesses a sheet resistance of 50.3 ohm/sq and a transmittance of 79.73%. The sheet resistance was only 15% of that exhibited by the Blank sample which performed the sheet resistance and transmittance of 339 ohm/sq and 78.25%, respectively, because the Ag nanoparticles generated more conductive pathways to lower the electrical resistance of the film and decrease thickness of TCFs.

Figure 4:
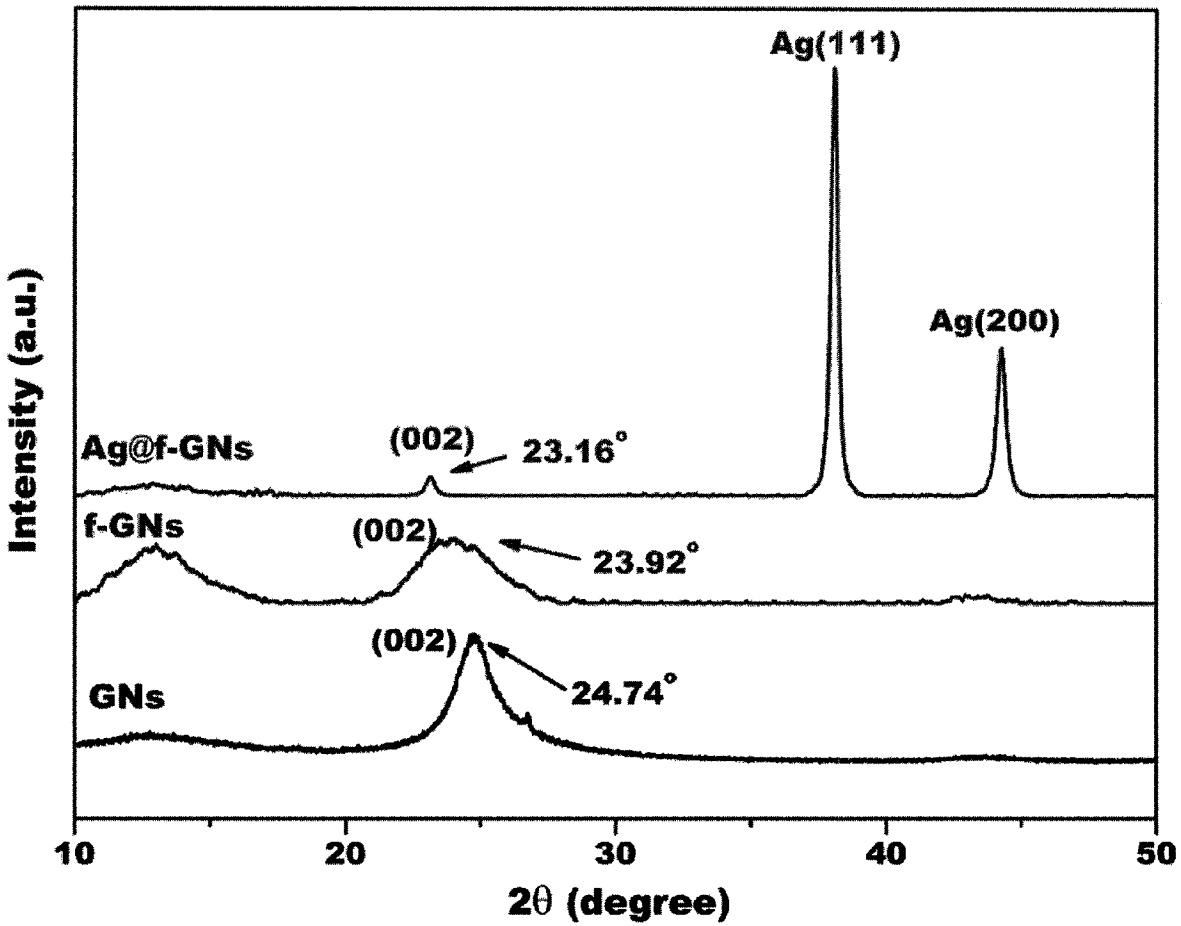
FIG. 4 shows a diagram of XRD patterns of GNs, f-GNs, and Ag@f-GNs.

Please refer to FIG. 4, FIG. 4 shows a diagram of XRD patterns of GNs, f-GNs, and Ag@f-GNs. The major peaks at 24.74° for GNs, 23.92° for f-GNs, and 23.16° for Ag@f-GNs represent the hexagonal (002) graphene plane corresponding to interlayer distances of 0.359, 0.372, and 0.384 nm for GNs, f-GNs, and Ag@f-GNs. Wherein, θ is the diffraction angle. The change in the diffraction angle by a magnitude of 1.58° from 24.74° for GNs to 23.16° for Ag@f-GNs illustrates the intercalation of Ag ions and/or Ag nanoparticles, which can cause an expansion of the graphitic interlayer after the Ag ions have been reduced. The intercalations of Ag ions and/or Ag nanoparticles can increase the conductive pathways between the interlayers of GNs. In other words, Ag nanoparticles can increase the conductivity between f-GNs by increasing the conductive pathways. Furthermore, the peaks at 38.10° and 44.28° correspond to the (111) and the (200) planes of the face-centered cubic Ag nanoparticles.

Figure 5A:
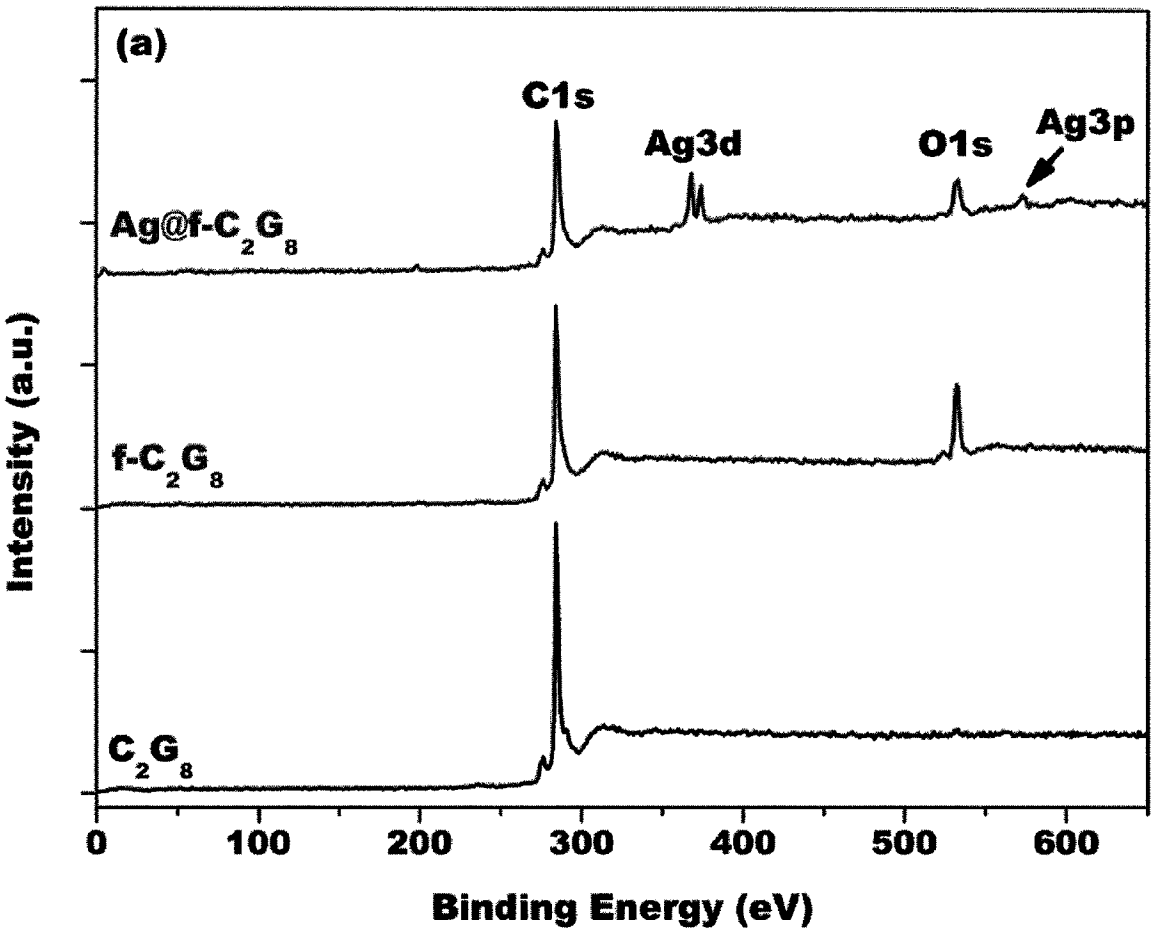
FIG. 5A shows a XPS spectra diagram of $C_2G_8$, f-$C_2G_8$, and Ag@f-$C_2G_8$.

Please refer to FIG. 5A, FIG. 5A shows a XPS spectra diagram of $C_2G_8$, f-$C_2G_8$, and Ag@f-$C_2G_8$. As shown in FIG. 5A, only the Cls can be detected in the $C_2G_8$ filler and no Ols peak can be found indicating high purity of the $C_2G_8$ filler. The Ols peak is detected in the f-$C_2G_8$ filler due to graft of carboxyl groups on the carbon material during the functionalization process. After Ag decoration, the Ag 3p and Ag 3d signals can be observed in the Ag@f-$C_2G_8$ filler.

Figure 5B:
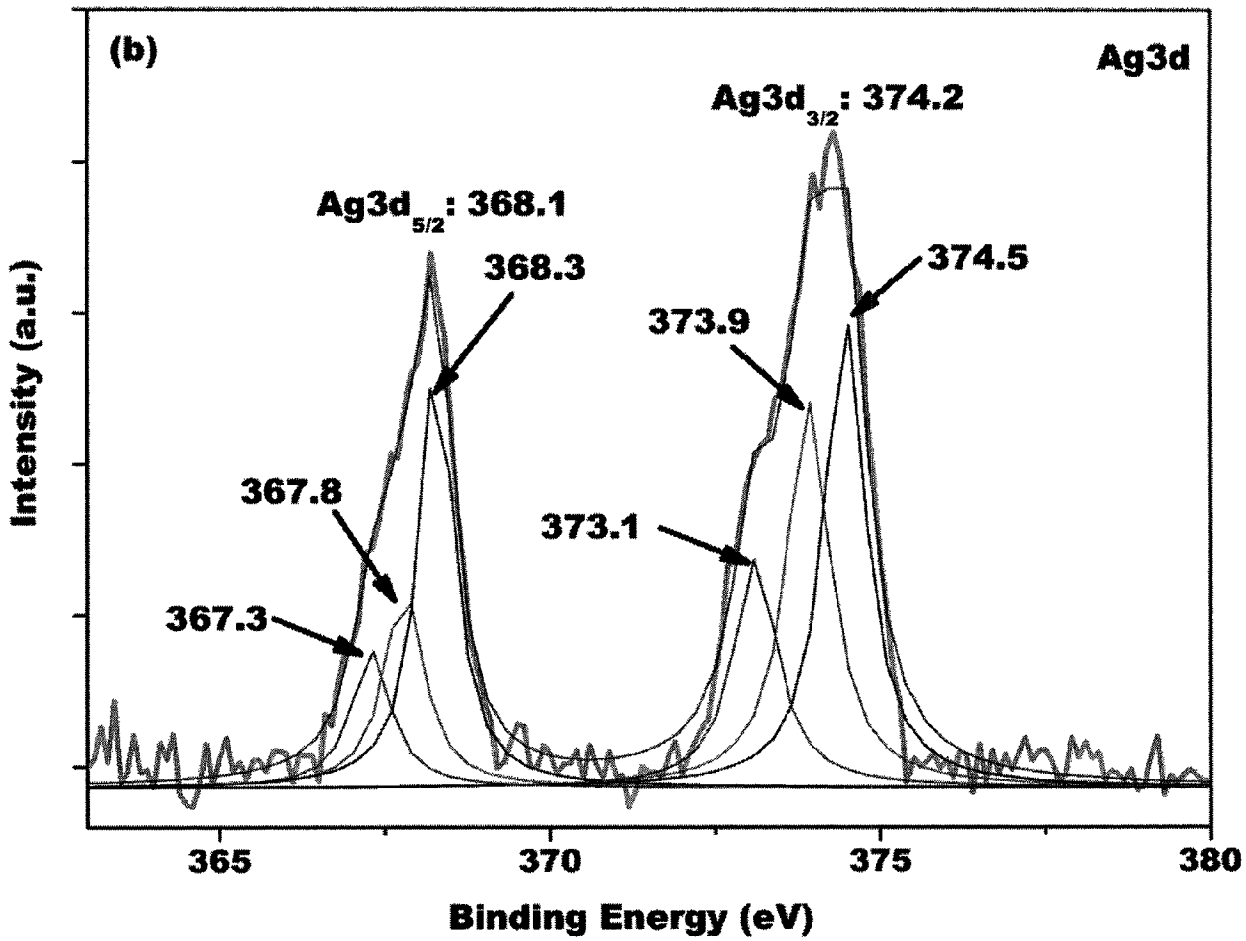
FIG. 5B shows a XPS spectra diagram of Ag@f-$C_2G_8$ at Ag 3 d region.

Please refer to FIG. 5B, FIG. 5B shows a XPS spectra diagram of Ag@f-$C_2G_8$ at Ag3d region. Among the Ag 3d spectra, the doublet can be identified at 368.1 and 374.2 eV correspond to the chemical state of $3d_{5/2}$ and $3d_{3/2}$, respectively. It is suggested that these two peaks correspond well to oxide-free Ag metallic nanoparticles. Furthermore, the Ag $3d_{5/2}$ peak can be resolved into three individual component peaks, located at 367.3, 367.8, and 368.3 eV, corresponding to AgO, $Ag_2O$, and Ag metallic state, respectively. 45 The Ag metallic state is dominating in the Ag@f-$C_2G_8$ filler because it has the largest area among these three fitted curves, indicating that the majority of the nanoparticles deco-rated on the carbon material surfaces are metallic Ag. The existence of AgO and $Ag_2O$ may arise from the intermediates during Ag decoration when ionic Ag reacted with the carboxyl groups. In addition, the slight shifts of these three fitted peaks toward a higher binding energy by 0.1-0.3 eV, as compared with the results reported for the Ag oxides and metal, are attributed to the presence of more electronegative oxygen atoms present from the functional groups on the carbon surfaces.

Figure 6:
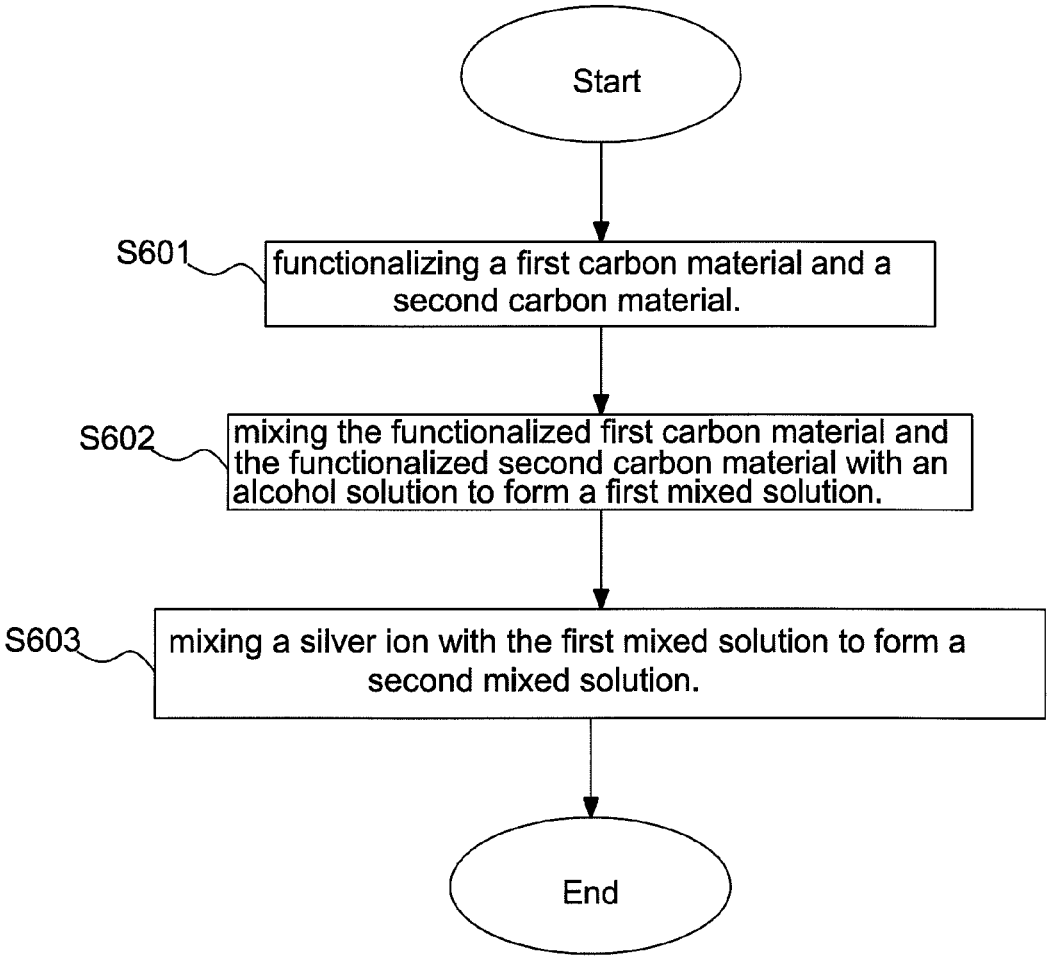
FIG. 6 shows a flow chart about decoration of silver onto carbon materials.

Please refer to FIG. 6, FIG. 6 shows a flow chart about decoration of silver onto carbon materials. The method for decoration of silver onto carbon materials comprise the following steps:

Step S601: functionalizing a first carbon material and a second carbon material.

Step S602: mixing the functionalized first carbon material and the functionalized second carbon material with an alcohol solution to form a first mixed solution.

Step S603: mixing a silver ion with the first mixed solution to form a second mixed solution.

While the present invention has been described by the way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

In conclusion, Ag@f-FWCNTs and Ag@f-GNs are mixed into the PEDOT:PSS matrix not only formed a three-dimensional network but also increased the contact points between the Ag nanoparticles and the fillers, resulting in increase in the number of electrical conductive pathways. In addition, the reduction of Ag ions to Ag nanoparticles increased the concentration of holes in both the fillers and the polymer matrix, leading to a reduction in the contact resistance. After Ag decoration, homogenous Ag nanoparticles are distributed uniformly on the surfaces of f-FWCNTs and f-GNs. Moreover, Ag ions and/or Ag nanoparticles can intercalate into the GN interlayer and expand the spacing between graphitic layers, which results in the increase of conductive pathways between interlayer between GNs. Ethanol was used both as a solvent and as an electron donor to dissolve and to reduce the Ag ions. When 2.0 wt % of Ag@f-FWCNTs and 8.0 wt % of Ag@f-GNs were used as fillers in the PEDOT:PSS matrix, the TCFs with an extremely low sheet resistance of 50.3 ohm/sq and a high transmittance of 79.73% at a wavelength of 550 nm were achieved. Therefore, the present invention can improve defects of original TCFs.

What is claimed is:

1. A method for decoration of silver onto carbon materials which comprising:

functionalizing a first carbon material and a second carbon material;

a mixing step, mixing the functionalized first carbon material and the functionalized second carbon material with an alcohol solution to form a first mixed solution;

mixing a silver ion with the first mixed solution to form a second mixed solution; and mixing the second mixed solution with an organic conductive polymer to form a flexible transparent conductive film.

2. The method according to claim 1, wherein the first carbon material comprises a carbon nanotube and the second carbon material comprises a graphene nanosheet.

3. The method according to claim 2, wherein the carbon nanotube is a few-walled carbon nanotubes (FWCNTs).

4. The method according to claim 3, wherein the few-walled carbon nanotubes have three to fifteen layers of carbon nanotubes.

5. The method according to claim 4, wherein the organic conductive polymer is poly(3,4-ethylenedioxythiophene)-poly(4-styrenesulfonate) (PEDOT:PSS).

6. The method according to claim 4, wherein the alcohol solution is an ethanol.

7. The method according to claim 5, wherein the silver ion is generated by silver nitrate ($AgNO_3$); and the silver ion increases hole concentration of PEDOT:PSS and conductivity of the flexible transparent conductive film.

8. The method according to claim 7, wherein the mixing step comprises:

mixing the functionalized first carbon material with the alcohol solution to form a first solution;

mixing the functionalized second carbon material with the alcohol solution to form a second solution; and mixing the first solution with the second solution to form the first mixed solution.

9. The method according to claim 7, wherein the first carbon material and the second carbon material is functionalized through a strong acid.

* * * * *